US007859481B2

(12) United States Patent
Muraoka

(10) Patent No.: US 7,859,481 B2
(45) Date of Patent: Dec. 28, 2010

(54) ANTENNA PATTERN AND ELECTROMAGNETIC-WAVE ENERGY PROCESSING DEVICE HAVING THE SAME

(75) Inventor: Kouji Muraoka, Sabae (JP)

(73) Assignee: Shuhou Co., Ltd., Fukui (JP)

( * ) Notice: Subject to any disclaimer, the term of this patent is extended or adjusted under 35 U.S.C. 154(b) by 598 days.

(21) Appl. No.: 10/578,017

(22) PCT Filed: Oct. 20, 2004

(86) PCT No.: PCT/JP2004/015486

§ 371 (c)(1),
(2), (4) Date: Mar. 19, 2007

(87) PCT Pub. No.: WO2005/048399

PCT Pub. Date: May 26, 2005

(65) Prior Publication Data

US 2008/0030424 A1 Feb. 7, 2008

(30) Foreign Application Priority Data

Nov. 12, 2003 (JP) ..... 2003-382818
Sep. 27, 2004 (JP) ..... 2004-279044

(51) Int. Cl.
*H01Q 1/36* (2006.01)

(52) U.S. Cl. ..... 343/897

(58) Field of Classification Search ..... 343/713, 343/897; 29/600

See application file for complete search history.

(56) References Cited

U.S. PATENT DOCUMENTS 2,063,531 A * 12/1936 Tuttle ..... 343/713
4,975,713 A * 12/1990 Sheriff ..... 343/795
5,365,242 A * 11/1994 Shiina ..... 343/713
6,154,185 A * 11/2000 Watanabe ..... 343/897
6,437,749 B2 * 8/2002 Nagayama et al. ..... 343/713

(Continued)

FOREIGN PATENT DOCUMENTS

CN 1360743 A 7/2002

(Continued)

OTHER PUBLICATIONS

Patent Abstracts of Japan of JP 02-256304 dated Oct. 17, 1990.

(Continued)

*Primary Examiner*—Tan Ho
(74) *Attorney, Agent, or Firm*—Ladas & Parry LLP

(57) ABSTRACT

An antenna pattern having a broad band characteristic as to frequencies and having a wide directivity, and an electromagnetic wave energy processing device having the antenna pattern, particularly a sheet-like antenna or electromagnetic wave shielding filter. A conductor wire forming the antenna pattern comprises an aggregated wire consisting of mesh or continuously polygonal micro-image element lines or parallel element lines. The element lines are 5-300 μm in line width and 5-1,000 μm in line pitch interval, or the most preferably 5-30 μm in line width and 5-150 μm in line pitch interval. The element lines are printed with printing ink or paste material mixed with conductive powder. In accordance with necessity, pressure treatment or polishing treatment and/or conductive plating with aid of eletroless plating or directly without aid of eletroless plating are performed on the printed surface.

18 Claims, 3 Drawing Sheets

U.S. PATENT DOCUMENTS

| | | | | |
|---|---|---|---|---|
| 6,661,391 | B2 * | 12/2003 | Ohara et al. | 343/895 |
| 7,209,039 | B2 * | 4/2007 | Krebs | 340/572.1 |
| 2003/0142018 | A1 * | 7/2003 | Lange | 343/700 MS |

FOREIGN PATENT DOCUMENTS

| | | |
|---|---|---|
| EP | 1 201 007 B1 | 1/2001 |
| FR | 2 796 208 | 1/2001 |
| JP | 02-256304 | 10/1990 |
| JP | 2-256304 | 10/1990 |
| JP | 10-32418 | 2/1998 |
| JP | 2003-90903 | 3/2003 |

OTHER PUBLICATIONS

Patent Abstracts of Japan of JP 2003-90903 dated Mar. 28, 2003.
esp@ cenet Abstract of Jan. 2, 2008 EP1201007 of Feb. 5, 2002.
Patent Abstracts of Japan of JP 10-.32418 dated Feb. 3, 1998.
Patent Abstracts of Japan of JP 2-256304 dated Oct. 17, 1990.

* cited by examiner (a)

(b)

ANTENNA PATTERN AND ELECTROMAGNETIC-WAVE ENERGY PROCESSING DEVICE HAVING THE SAME

BACKGROUND OF THE INVENTION

1. Field of the Invention

The present invention relates to an antenna pattern for use in a television set, a cellular phone or the like, and an electromagnetic-wave energy processing device having the antenna pattern, particularly a sheet-like antenna or electromagnetic wave shielding filter.

2. Background Art

With the popularization of television sets or cellular phones, various antenna forms have been developed.

However, clearness of display images thereon is not always satisfactory. There has been therefore a strong request for clearness of images on displays. In addition, receiving frequencies have been also made higher and higher from VHF (Very High Frequency to UHF Micro Wave. Antennas corresponding thereto have been therefore devised (for example, see Patent Document 1).

As for antennas for displays for automobile use, antenna patterns provided in glass surfaces of rear portions of cars have been devised variously (for example, see Patent Document 2).

On the other hand, electromagnetic waves propagated from various electromagnetic wave generating sources, particularly from electronic devices such as cellular phones, have influence on human bodies, causing severe social problems.

Patent Document 1: JP-A-2000-4120

Patent Document 2: JP-A-2000-252732

SUMMARY OF THE INVENTION

Problems that the Invention is to Solve

As described above, there has been a growing tendency for the market to request clearer images, and there has been a strong request for a method for obtaining clear images on a proven and established base of background-art antenna patterns without any basic change.

There has been also a request for an electromagnetic wave shielding filter richer in multi-directivity and more efficient.

In order to meet these requests, an object of the present invention is to provide an antenna pattern for obtaining a clearer display image without any basic change on an image of a background-art antenna pattern, and to provide an electromagnetic wave energy processing device using the antenna pattern, particularly a sheet-like antenna or electromagnetic wave shielding filter.

Means for Solving the Problems

The antenna pattern according to the present invention is:

1) an antenna pattern in which a conductor wire forming the antenna pattern is formed out of an aggregated wire consisting of mesh or continuously polygonal micro-image element lines or an aggregated wire consisting of parallel element lines;
2) an antenna pattern in the above-mentioned paragraph 1), in which the mesh or continuously polygonal micro-image element lines or the parallel element lines are made 5-300 μm in line width and 5-1,000 μm in line pitch interval;
3) an antenna pattern in the above-mentioned paragraph 1), in which inch the mesh or continuously polygonal micro-image element lines or the parallel element lines are made 5-50 μm in line width and 5-500 μm in line pitch interval;
4) an antenna pattern in the above-mentioned paragraph 1), in which the mesh or continuously polygonal micro-image element lines or the parallel element lines are made 5-30 μm in line width and 5-150 μm in line pitch interval; or
5) an antenna pattern in the above-mentioned paragraph 1), in which the mesh or continuously polygonal micro-image element lines or the parallel element lines are made 30-300 μm in line width and 50-1,000 μm in line pitch interval.

The antenna pattern according to the present invention is adapted as:

6) an antenna pattern in any one of the aforementioned paragraphs 1) through 5), in which the mesh or continuously polygonal micro-image element lines or the parallel element lines are produced by use of a printing method or an etching system;
7) an antenna pattern in any one of the aforementioned paragraphs 1) through 5), in which the mesh or continuously polygonal micro-image element lines or the parallel element lines are printed with printing ink or paste material mixed with conductive powder;
8) an antenna pattern in any one of the aforementioned paragraphs 1) through 5), in which the mesh or continuously polygonal micro-image element lines or the parallel element lines are printed with printing ink or paste material mixed with conductive powder, and conductive plating is further performed on the printed surface with or without aid of eletroless plating;
9) an antenna pattern in any one of the aforementioned paragraphs 1) through 5), in which the mesh or continuously polygonal micro-image element lines or the parallel element lines are printed with printing ink or paste material mixed with conductive powder, and pressure treatment or polishing treatment is performed further on the printed surface;
10) an antenna pattern in any one of the aforementioned paragraphs 1) through 5), in which the mesh or continuously polygonal micro-image element lines or the parallel element lines are printed with printing ink or paste material mixed with conductive powder, pressure treatment or polishing treatment is further performed on the printed surface, and conductive plating is further performed on the printed surface with or without aid of eletroless plating;
11) an antenna pattern in any one of the aforementioned paragraphs 7) through 9), in which the conductive powder has an average particle size of 0.001-10 μm, and is selected from Cu, Ti, Fe, Ni, Mg, Pd, Ag, Au and C, or alloys thereof; or
12) an antenna pattern in any one of the aforementioned paragraphs 1) through 5), in which the conductor wire has an amorphous alloy as a constituent component thereof.

Further, the electromagnetic wave energy processing device according to the present invention is designed as:

13) an electromagnetic wave energy processing device including an antenna pattern according to any one of the aforementioned paragraphs 1) through 12);
14) an electromagnetic wave energy processing device in which an antenna pattern according to any one of the aforementioned paragraphs 1) through 12) is provided on a sheet or a thin plate;
15) an electromagnetic wave energy processing device in which an antenna pattern according to any one of the aforementioned paragraphs 1) through 12) is provided on a sheet or a thin plate, and a coating or a thin sheet is laminated further thereon;

16) an electromagnetic wave energy processing device set as an antenna having an antenna pattern according to any one of the aforementioned paragraphs 1) through 12); or 17) an electromagnetic wave energy processing device set as an electromagnetic wave shielding filter having an antenna pattern according to any one of the aforementioned paragraphs 1) through 12).

According to the present invention, a conductor wire which would be formed out of a solid wire in the background art is formed out of an aggregated wire consisting of mesh or continuously polygonal micro-image element lines or a parallel element wire. As a result, the directivity of the conductor wire itself is improved as multi-directional one in comparison with the solid conductor wire. A broad band characteristic can be also provided in accordance with the effective length of the conductor. Further, an effect as a noise filter can be obtained.

Thus, without any change on a background-art antenna pattern which would be formed out of a solid wire, the performance thereof can be improved.

Due to the expected improvement in performance, a background-art antenna itself can be miniaturized or a pattern image can be simplified when the conductor wire formed out of an aggregated wire or a parallel element wire according to the present invention is used.

DETAILED DESCRIPTION OF THE PREFERRED EMBODIMENTS

EFFECT OF THE INVENTION

Figure 1:
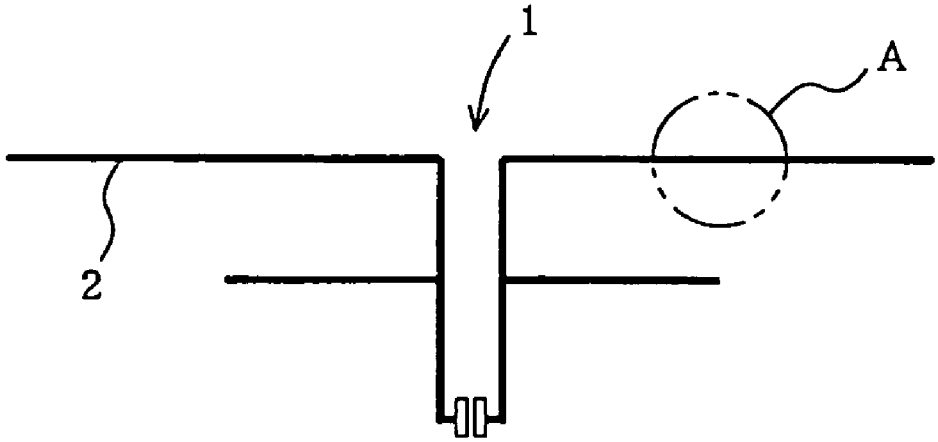
FIG. 1 illustrates a reference diagram showing an antenna pattern of Example 1 of the present invention.

A conductor wire forming an antenna pattern according to the present invention is formed out of an aggregated wire consisting of mesh or continuously polygonal micro-image element lines or a parallel element wire. Accordingly, the antenna pattern can support a broad band of frequencies, and the directivity can be improved. In addition, due to an effect as a noise filter, a clearer image on a display can be obtained. It is therefore possible to supply an antenna which can support a UHF TV broadcast frequency band and a VHF TV broadcast frequency band satisfactorily, and which can be expected to have an image clearer and more stable than that in the background art.

The antenna pattern is also applicable to an electromagnetic wave shielding filter which is rich in multi-directivity and efficient.

BEST MODE FOR CARRYING OUT THE INVENTION

An antenna pattern according to the present invention is an antenna pattern mainly for a flat antenna for domestic use or for automobile use, which is characterized as follows. A solid conductor wire using Cu-plating or the like has been produced in a background-art photo-etching process (hereinafter referred to as etching system) or the like. The conductor wire itself is further formed out of an aggregated wire consisting of mesh or continuously polygonal micro-image element lines or parallel element lines.

That is, the present invention is characterized in that the micro-image element lines form a conductor wire as an aggregated wire using a curb mesh image or a continuously polygonal image, preferably a continuous image of polygons, or using parallel element lines.

The parallel element wire is not limited to parallel element wire with parallel straight lines. The parallel element wire may be formed out of a parallel wire with parallel lines of arc curves or waved curves, parallel zigzag lines continuously bent straight lines, or the like.

When the antenna pattern is configured thus, the length as the aggregated wire as well as the length by the antenna pattern can be expected as the substantial length for an antenna or an electromagnetic wave shield so as to support a broadband frequency f (wavelength $\lambda$). Thus, the antenna pattern has multi-directivity.

The micro-image element wire or the parallel element wire can be produced in a printing method chiefly including a screen printing method, a pad printing method, a gravure printing method, an inkjet printing method, etc. Moreover, in the printing method, the micro-image element wire or the parallel element wire are printed with synthetic ink produced by mixing conductive powder into printing ink or conductive paste material. It is therefore necessary to select constitution satisfactorily suitable for the specification of the constituent conductor wire, the printing method, the characteristic or mixing ratio of the conductive power to be contained, the printing step itself and changes in subsequent steps, etc.

Needless to say, the present invention does not prevent the micro-image element wire or the parallel element wire from being formed as an aggregated wire of a conductor wire in a current etching system developed highly. In this case, there is a disadvantage in terms of cost as compared with the printing method.

The conductive powder to be mixed into the synthetic ink is selected from Cu, Ti, Fe, Ni, Mg, Pd, Ag, Au and C or alloys of those, whose average particle size is 0.001-10 μm.

If the particle size is smaller than 0.001 μm, the cost will increase due to difficulty in production. If the particle size is larger than 10 μm, it will be difficult to print extremely fine lines with the synthetic ink. Any conductive power may be used if it has good conductivity. It is, however, preferable to use a material well balanced in terms of cost and performance. Pd powder is preferred.

When a width t of each element line of the conductor wire is comparatively large, for example, to be 30-300 μm, a screen printing method or a gravure printing method can be used. In this case, a conductive paste material or the like is used as ink. As the conductive paste material, it is possible to use a polyester resin based material, an epoxy resin based material or the like, where ultrafine powder of Ag or Cu is mixed. When ultrafine powder with an average particle size of about 0.5 μm is used, the surface area per volume increases extremely so that good conductivity can be obtained.

The length of the antenna pattern is generally set as ¼ of the wavelength of a normally received radio wave. Accordingly, in order to support radio waves of different frequencies, for example, a $VHF_H$ TV broadcast high frequency band, a $VHF_L$ TV broadcast low frequency band, an FM radio broadcast band, etc., the antenna pattern has to be set with adaptive lengths corresponding to the frequencies.

The present inventor discovered that an antenna pattern can support a broad band if the antenna pattern is formed out of an aggregate of fine lines. In addition, the present inventor obtained knowledge that the performance of the antenna pattern changes largely in accordance with the conditions with which the aggregate is formed.

As a result of a large number of experiments, it was proved that lattice type mesh or continuously polygonal micro-image element lines, for example, continuously polygonal micro-image element lines are preferable as a preferable aggregate of element lines. The continuous polygon such as triangles, quadrangles, pentagons, hexagons, octagons, etc. or continuous arc images other than polygonal images may be used for the micro-image element lines.

It is preferable that the micro-image element lines or the parallel element lines are 5-300 μm in line width and 5-1,000 μm in line pitch interval. It is more preferable that the micro-image element lines or the parallel element lines are set to be 5-50 μm in line width and 5-500 μm in line pitch interval, and particularly as 5-30 μm in line width and 5-150 μm in line pitch interval. In terms of cost and mass productivity, it is preferable that the screen printing method or the gravure printing method is used with the line width set as 30-300 μm and the line pitch interval set as 50-1,000 μm. In this case, however, the performance deteriorates due to decrease in aggregate density.

That is, in order to make the antenna pattern support a broad band in a frequency to be received, it is desired that the number of fine lines extending in the longitudinal direction of the aggregate of the fine lines is large. In addition, since the radio wave receiving ability is proportional to the surface area of a receiving conductor, the line width and the line pitch interval have limitation for themselves. From a large number of experiments, the knowledge that the aforementioned conditions are preferable was obtained.

If the line width is smaller than 5 μm, the receiving ability will decrease suddenly. If the line width is larger than 50 μm, the number of fine lines in the aggregate will be limited. When the line pitch interval is larger than 500 μm, an image of the conductor becomes large and the number of lines in the aggregate is largely limited so that the performance will deteriorate. When the line pitch interval is smaller than 5 μm, the workability of printing will be extremely bad unpreferably.

EXAMPLE 1

FIG. 1 is a diagram showing an antenna pattern in Example 1 of the present invention.

Figure 2:
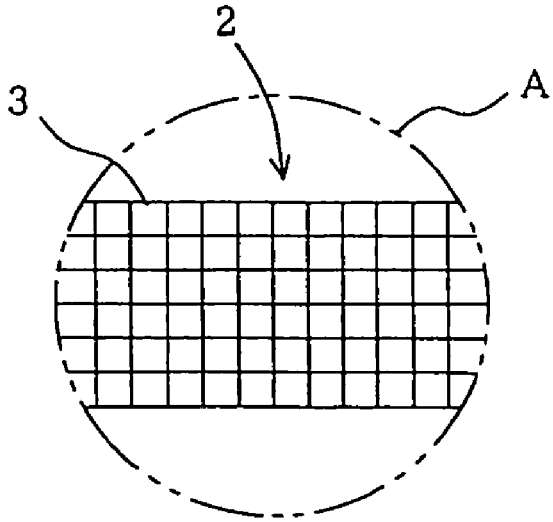
FIG. 2 illustrates an enlarged reference diagram of a portion A in FIG. 1, showing an example where an aggregated wire consists of very thin mesh micro-image element lines.

FIG. 2 is an enlarged reference diagram of a portion A in FIG. 1, showing an example where the aggregated wire consists of lattice type mesh micro-image element lines.

In the drawings, the reference numeral 1 represents an antenna pattern; 2, a conductor wire; and 3, mesh micro-image element lines.

The antenna pattern in Example 1 was formed to be 2 mm in width of a conductor wire, 39 cm in length of a long wire portion, 25 cm in length of a short wire portion and 3 cm in interval between the two wires, while the conductor wire was formed as an aggregated wire having a lattice type mesh pattern. The line width was set to be 20 μm and the line pitch interval was set to be 100 μm. The antenna pattern was printed by offset printing with synthetic ink mixed with Pd powder having an average particle size of 1 μm. Cu-plating about 1 μm thick was performed upon the printed surface by electroless plating.

For the sake of comparison, an antenna pattern with the same pattern, in which the aforementioned conductor wire consisted of not an aggregated wire but a solid wire plated with Cu and photo-etched, was produced as Comparative Product 1.

The aforementioned antennas were connected to a standard commercially available TV receiver as indoor TV antennas, and the degree of clearness of images thereof were compared visually.

As a result, in Comparative Product 1, a VHF received image was good, but the clearness of an image surface of a UHF received image deteriorated to some extent, and image blurring was recognized. On the other hand, according to Example 1 of the invention, it was confirmed that clear images could be obtained in respective channels both as a VHF received image and as a UHF received image.

EXAMPLE 2

Figure 3:
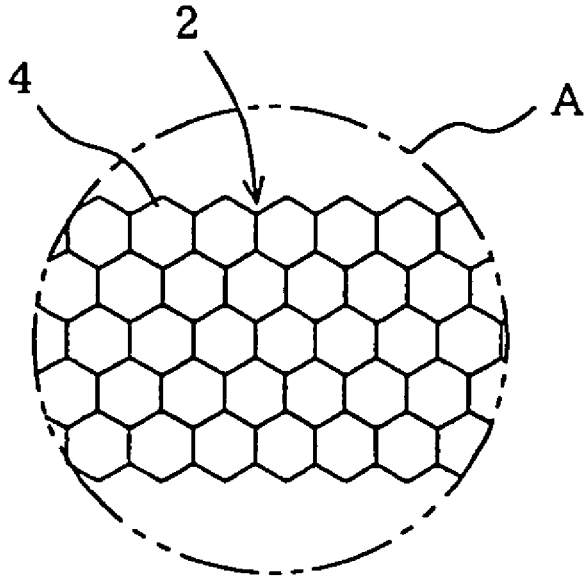
FIG. 3 illustrates an enlarged reference diagram of a portion A in Example 2 of the present invention, showing an example where an aggregated wire consists of very thin continuously polygonal micro-image element lines.

FIG. 3 is an enlarged reference diagram of a portion A in Example 2 of the present invention, showing an example where the aggregated wire consists of continuously polygonal micro-image element lines.

In the drawing, the reference numeral 4 represents a continuously polygonal micro-image element lines.

In the same manner as in Example 1, the antenna pattern in Example 2 was formed to be 2 mm in width of a conductor wire, 39 cm in length of a long wire portion, 25 cm in length of a short wire portion and 3 cm in interval between the two wires, while the conductor wire was formed as an aggregated wire having a lattice type mesh pattern. The line width was set to be 20 μm, and the pitch between opposite sides of each continuous polygonal shape was set to be 100 μm. The antenna pattern was printed by offset printing with synthetic ink mixed with Pd powder having an average particle size of 1 μm. Cu-plating about 1 μm thick was performed upon the printed surface by electroless plating.

For the sake of comparison, an antenna pattern with the same pattern, in which the aforementioned conductor wire consisted of not an aggregated wire but a solid wire plated with Cu 1 μm thick and photo-etched was produced as Comparative Product 2.

In the same manner as in Example 1, the aforementioned antennas were connected to a standard commercially available TV receiver as indoor TV antennas, and the degree of clearness of images thereof were compared visually.

As a result, in the comparative product, a VHF received image was good, and a UHF received image was a little better than that of Comparative Product 1 of Example 1, but image blurring of an image surface was recognized. On the other hand, according to Example 2 of the invention, it was confirmed that extremely good and clear images could be obtained in respective channels both as a VHF received image and as a UHF received image.

EXAMPLE 3

Figure 4:
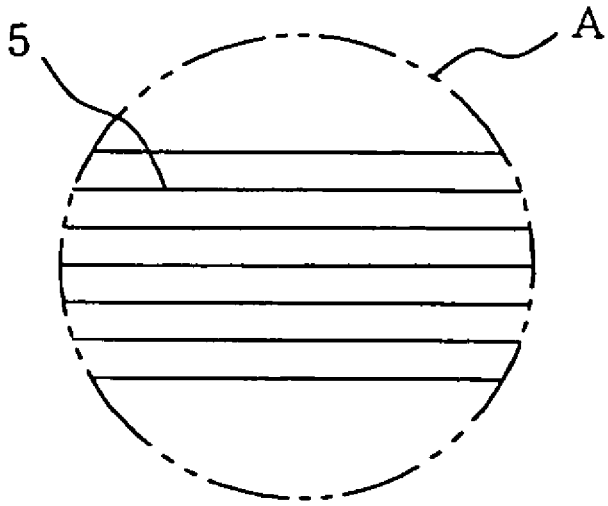
FIG. 4 illustrates an enlarged reference diagram of a portion A in Example 3 of the present invention, showing an example where an aggregated wire consists of very thin parallel aggregated lines.

FIG. 4 is an enlarged reference diagram of a portion A in Example 3 of the present invention, showing an example where the aggregated wire consists of parallel aggregated lines.

In the drawing, the reference numeral 5 represents a parallel aggregated lines like a straight lines.

In the same manner as in Example 1, the antenna pattern in Example 3 was formed to be 2 mm in width of a conductor wire, 39 cm in length of a long wire portion, 25 cm in length of a short wire portion and 3 cm in interval between the two wires, while the conductor wire was formed as a parallel aggregated wire. The line width was set to be 20 μm, and the line pitch was set to be 100 μm. The antenna pattern was printed by offset printing with synthetic ink mixed with Pd powder having an average particle size of 1 μm. Cu-plating about 1 μm thick was performed upon the printed surface by electroless plating.

For the sake of comparison, an antenna pattern with the same pattern, in which the aforementioned conductor wire consisted of not an aggregated wire but a solid wire plated with Cu 1 μm thick and photo-etched, was produced as Comparative Product 3.

In the same manner as in Example 1, the aforementioned antennas were connected to a standard commercially available TV receiver as indoor TV antennas, and the degree of clearness of images thereof were compared visually.

As a result, in Comparative Product 3, a VHF received image was good, but in a UHF received image, blurring of an image surface was recognized as compared with those of Comparative Products 1 and 2. On the other hand, according to Example 3 of the invention, it was confirmed that images were good in respective channels both as a VHF received image and as a UHF received image, but the image quality was degraded slightly as compared with the cases of Examples 1 and 2.

EXAMPLE 4

Color coating of plastic about 50 μm thick was further applied to the surface of the antenna pattern of Example 2, and receiving performance was compared. Little influence of the color coating was recognized. It was therefore confirmed that a flat antenna using an antenna pattern according to the present invention in which an image of characters or the like was printed on the color coating surface could be used by way of indoor ornament.

EXAMPLE 5

Figure 5:
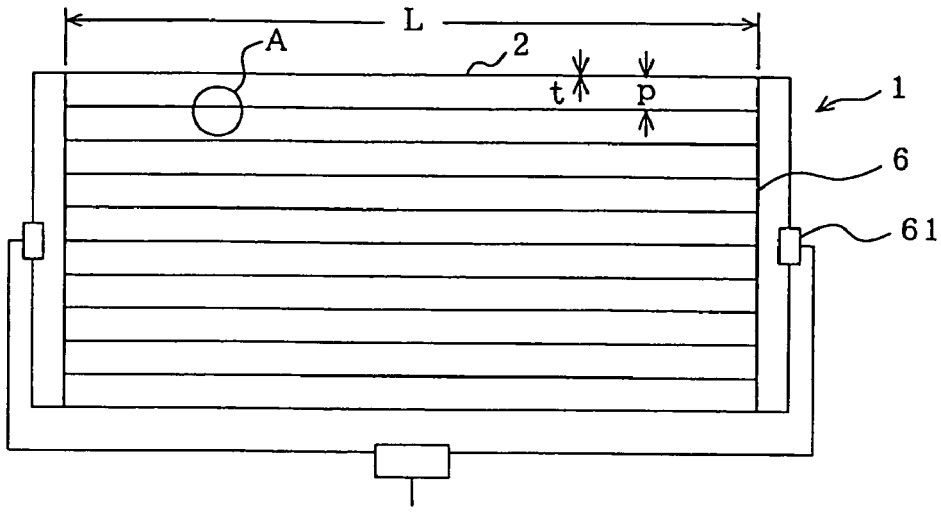
FIG. 5 illustrates reference diagrams showing an antenna pattern in Example 5 of the present invention.
Figure 5:
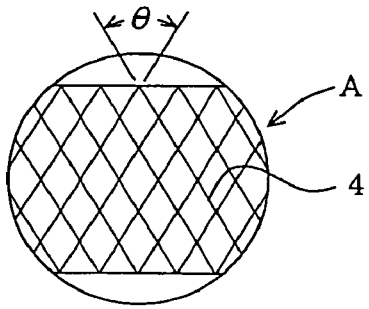

As shown in FIGS. 5, an antenna pattern was formed as a pattern of parallel wires in which conductor wire width t was 2 mm, conductor wire pitch p was 10 mm, conductor wire length L was 200 mm, and the number n of parallel wires was 10, while the conductor wire was formed as an aggregated wire of continuous vertical diamond shapes each having a vertex angle of 60°. In FIG. 1, the reference numeral 1 represents an antenna pattern; 2, a conductor wire; 4, a micro-image element lines; 6, a common electrode; 61, a coil; t, a conductor wire width; p, a conductor wire pitch; L, a conductor wire length; and θ, a vertex angle.

The micro-image element wire forming the antenna pattern is formed as an aggregated wire of continuous vertical diamond shapes. A) The aggregated wire was formed as an aggregated wire consisting of very thin lines with a line width of 20 μm and a line pitch of 100 μm by accurate offset printing with synthetic ink mixed with Cu powder having an average particle size of 1 μm, and B) the aggregated wire was formed as an aggregated wire consisting of the lines with a line width of 70 μm and a line pitch of 500 μm by a screen printing method with a conductive paste material mixed with Cu powder having an average particle size of 1 μm. The electromagnetic wave shielding effects thereof were comparatively tested by ASTM ES/7/83.

As a result of measurement, there was a large variation in measured values at the same frequency so that comparison on absolute values could not be obtained. It was, however, estimated that there was a significant difference in the average shielding effect. The antenna pattern A) showed a shielding effect about twice as high as the antenna pattern B). The antenna pattern B) showed about 35 dB.

It was proved that the electromagnetic wave shielding effect can be expected in accordance with selection of an antenna pattern.

INDUSTRIAL APPLICABILITY

Antenna patterns according to the present invention have been described as those for TV antennas in its embodiment. However, the antenna patterns can be used for applications over a broad band of frequencies. The antenna patterns are applicable to receiving or transmitting antennas for radios, FM stations, mobile stations of taxies or the like, radars, etc. The antenna patterns can be also used as various electromagnetic wave shielding devices.

DESCRIPTION OF REFERENCE NUMERALS AND SIGNS

1 antenna pattern
2 conductor wire
3 mesh micro-image element lines
4 continuously polygonal micro-image element lines
5 very thin parallel aggregated line
6 common electrode
61 coil
t conductor wire width
p conductor wire pitch
L conductor wire length

The invention claimed is:

1. An antenna pattern, comprising:

a conductor wire forming the antenna pattern, the conductor wire being formed out of an aggregated wire consisting of mesh or continuously polygonal micro-image element lines or an aggregated wire consisting of parallel element lines, wherein the mesh or continuously polygonal micro-image element lines or the parallel element lines are printed with printing ink or paste material mixed with conductive powder, and conductive plating is further performed on the printed surface with or without aid of eletroless plating.

2. The antenna pattern according to claim 1, wherein the mesh or continuously polygonal micro-image element lines or the parallel element lines are 5-300 μm in line width and 5-1,000 μm in line pitch interval.

3. The antenna pattern according to claim 1, wherein the mesh or continuously polygonal micro-image element lines or the parallel element lines are 5-50 μm in line width and 5-500 μm in line pitch interval.

4. The antenna pattern according to claim 1, wherein the mesh or continuously polygonal micro-image element lines or the parallel element lines are 5-30 μm in line width and 5-150 μm in line pitch interval.

5. The antenna pattern according to claim 1, wherein the mesh or continuously polygonal micro-image element lines or the parallel element lines are 30-300 μm in line width and 50-1,000 μm in line pitch interval.

6. The antenna pattern according to claim 1, wherein the mesh or continuously polygonal micro-image element lines or the parallel element lines are produced by use of a printing method or an etching system.

7. The antenna pattern according to claim 1, wherein the conductor wire has an amorphous alloy as a constituent component thereof.

8. A sheet-like electromagnetic wave energy processing device wherein the antenna pattern according to claim 1 is provided on a sheet or a thin plate.

9. A sheet-like electromagnetic wave energy processing device, in which an antenna pattern according to claim 1 is provided on a sheet or a thin plate, and a coating or a thin sheet is laminated further thereon.

10. An electromagnetic wave energy processing device, in which the electromagnetic wave energy processing device is an antenna having the antenna pattern according to claim 1.

11. An electromagnetic wave energy processing device, in which the electromagnetic wave energy processing device is an electromagnetic wave shielding filter having the antenna pattern according to claim 1.

12. An electromagnetic wave energy processing device comprising the antenna pattern according to claim 1.

13. An antenna pattern, comprising:

a conductor wire forming the antenna pattern, the conductor wire being formed out of an aggregated wire consisting of mesh or continuously polygonal micro-image element lines or an aggregated wire consisting of parallel element lines, wherein the mesh or continuously polygonal micro-image element lines or the parallel element lines are printed with printing ink or paste material mixed with conductive powder, and at least one of predetermined pressure treatment and polishing treatment are performed further thereon.

14. An electromagnetic wave energy processing device comprising the antenna pattern according to claim 13.

15. An antenna pattern, comprising:

a conductor wire forming the antenna pattern, the conductor wire being formed out of an aggregated wire consisting of mesh or continuously polygonal micro-image element lines or an aggregated wire consisting of parallel element lines, wherein the mesh or continuously polygonal micro-image element lines or the parallel element lines are printed with printing ink or paste material mixed with conductive powder, at least one of predetermined pressure treatment and polishing treatment are further performed on the printed surface, and conductive plating is further performed on the printed surface with or without aid of eletroless plating.

16. An electromagnetic wave energy processing device comprising the antenna pattern according to claim 15.

17. An antenna pattern, comprising:

a conductor wire forming the antenna pattern, the conductor wire being formed out of an aggregated wire consisting of mesh or continuously polygonal micro-image element lines or an aggregated wire consisting of parallel element lines, wherein the mesh or continuously polygonal micro-image element lines or the parallel element lines are printed with printing ink or paste material mixed with conductive powder, wherein the conductive powder has an average particle size of 0.001-10 μm, and is selected from Cu, Ti, Fe, Ni, Mg, Pd, Ag, Au and C, or alloys thereof.

18. An electromagnetic wave energy processing device comprising the antenna pattern according to claim 17.

* * * * *